US012172821B1

(12) United States Patent
Wang

(10) Patent No.: US 12,172,821 B1
(45) Date of Patent: Dec. 24, 2024

(54) VACUUM AIRTIGHT CONTAINER

(71) Applicant: Jui-Te Wang, Taichung (TW)

(72) Inventor: Jui-Te Wang, Taichung (TW)

( * ) Notice: Subject to any disclaimer, the term of this patent is extended or adjusted under 35 U.S.C. 154(b) by 32 days.

(21) Appl. No.: 18/225,155

(22) Filed: Jul. 23, 2023

(51) Int. Cl.
*B65D 81/20* (2006.01)
*B65D 51/16* (2006.01)

(52) U.S. Cl.
CPC ..... *B65D 81/2015* (2013.01); *B65D 51/16* (2013.01); *B65D 2203/02* (2013.01); *B65D 2205/00* (2013.01)

(58) Field of Classification Search
CPC ..... A47J 47/02; B65D 43/02; B65D 43/26; B65D 51/16; B65D 51/1644; B65D 51/165; B65D 51/1683; B65D 81/20; B65D 81/2015; B65D 81/2038; B65D 2203/02; B65D 2205/00
USPC ..... 206/524.8; 220/212
See application file for complete search history.

(56) References Cited

U.S. PATENT DOCUMENTS

| | | | | |
|---|---|---|---|---|
| 6,789,690 | B2 * | 9/2004 | Nieh | B65D 81/2015 220/212 |
| 7,048,136 | B2 * | 5/2006 | Havens | B65D 51/1644 206/524.8 |
| 8,936,169 | B2 * | 1/2015 | Lui | B65D 81/2038 206/524.8 |
| 9,145,242 | B2 * | 9/2015 | Wang | B65D 51/1644 |
| 9,850,047 | B2 * | 12/2017 | Wang | B65D 51/1683 |
| 10,968,025 | B2 * | 4/2021 | Wei | B65D 81/2015 |

* cited by examiner

*Primary Examiner* — Bryon P Gehman

(57) ABSTRACT

A vacuum airtight container, including a container, a cover, an elastic outlet unit, a control unit, and an exhaust unit. The container has a storage space. The cover is covered and sleeved on the top of the container; wherein the cover has a control groove and an exhaust groove, the control groove has a through hole and the exhaust groove has an exhaust hole, the through hole and the exhaust hole are communicated with the storage space correspondingly. The control unit has a control member movably arranged at the control groove of the cover. The exhaust unit has an exhaust member disposed on the exhaust groove of the cover. When the exhaust member is pulled upwards, the air in the storage space is discharged out of the container through the exhaust hole, so that the storage space of the container forms an approximate vacuum state.

10 Claims, 10 Drawing Sheets

VACUUM AIRTIGHT CONTAINER

FIELD OF THE DISCLOSURE

The present disclosure is related to the technical field related to airtight containers, in particular to a control unit provided on the cover of the container, which facilitates the assembly and disassembly of the cover and the container.

BACKGROUND OF THE DISCLOSURE

Conventional moisture-proof containers can store food and effectively isolate the air from outside of the container, so as to prevent food from getting moisture. As disclosed in TW M384166, which is a moisture-proof container composed of a container and a cover. The container is provided with storage space with an opening, and the cover can close the opening of the container. In detail, the wall surface of the storage space of the container and the cover is coated with a layer of natural lacquer, so that the container and the cover can be adjacent to the storage space with a layer of film. The active Laccase enzyme contained in the natural lacquer is used to absorb the moisture in the storage space and continuously dry the storage space, so that the food can be prevented from getting moisture.

However, the active Laccase enzyme film coating of the conventional moisture-proof container is coated on the inner side of the container and cover, which results in a bad effect on the quality of the food when the food touches the film. Therefore, improving the lack of conventional moisture-proof containers is the primary research focus of the present disclosure.

SUMMARY OF THE DISCLOSURE

The present disclosure provides a vacuum airtight container. By providing an exhaust unit on the cover, the exhaust unit allows the container to form an approximate vacuum state to achieve the purpose of preserving food.

The present disclosure is related to a vacuum airtight container. By providing a control unit on the cover, the cover is easy to open or close through the control unit, so as to achieve the purpose of easy assembly or disassembly.

The present disclosure provides a vacuum airtight container. By providing an elastic outlet unit on the cover, the fermented gas of the food in the container can be discharged to preserve food.

The airtight container of the present disclosure includes a container, a cover, an elastic outlet unit, a control unit, and an exhaust unit. The container has a storage space. The cover is covered and sleeved on the top of the container. Further, the cover has an outlet groove and a control groove, the outlet groove has an outlet hole, and the control groove has a through hole, and the outlet hole and the through hole are communicated with the storage space correspondingly.

The control unit has a control member movably arranged at the control groove of the cover. When pressing the control member, the through hole of the control groove forms an open state and communicates with the storage space of the container. The exhaust unit has an exhaust member disposed on the exhaust groove of the cover. When the exhaust member is pulled upwards, the air in the storage space of the container is discharged out of the container through the exhaust hole of the exhaust groove, so that the storage space of the container forms an approximate vacuum state.

In certain embodiments, the cover includes an outlet groove having an outlet hole communicated with the storage space; wherein the outlet groove and the exhaust groove are disposed on the top of the cover, and the control groove is disposed on the side of the cover; wherein the outlet groove has a first joint surface, and a stop ring convexly encircled the first joint surface.

In certain embodiments, the airtight container further includes an elastic outlet unit. The elastic outlet unit has a first connecting portion, and the first connecting portion of the elastic outlet unit is connected to the outlet hole of the outlet groove and is limited by the stop ring.

In certain embodiments, the control unit has a fastener member and an elastic member, and the control member has an axis part; wherein the fastener member and the elastic member are detachable and assembled on the axis part, and the fastener member closes the through hole of the control groove when the axis part inserts the control groove from outside of the cover.

In certain embodiments, the axis part of the control member has a recess. When the control member is pushed, the elastic member will be pushed, and the axis part of the control member will protrude from the through hole of the control groove to the inner side of the cover, so that the fastener member of the through hole of the control groove forms an open state. Therefore, external air is allowed to enter the storage space of the container from the through hole of the control groove through the recess of the axis part of the control member, and a communication state is formed.

In certain embodiments, the exhaust unit further includes a pressing part, an elastic positioning ring, and an elastic leakage stopper; the pressing part has an annular groove recessed at the side wall, a pulling handle on the top, and an airflow groove portion recessed at the bottom. Further, the airflow groove portion has a protrusion, the outer edge of the pressing part has a plurality of slots communicating with the annular groove, and the elastic positioning ring is slid in the annular groove of the pressing part; During the process of pulling up or pushing down the exhaust member, the elastic positioning ring moves up and down with the annular groove of the pressing part; Further, the elastic leakage stopper has a second connecting portion corresponding to the location of the exhaust hole of the exhaust groove, and the elastic leakage stopper connects to the exhaust hole of the exhaust groove, and the protrusion of the airflow groove portion is abutted against on the elastic leakage stopper.

In certain embodiments, the exhaust unit further includes a fixing member, which is hollow and includes a first retaining part fitted to a second retaining part of the exhaust groove. Further, the second retaining part complements the first retaining part, so the exhaust member can be retained at the exhaust groove in operation. Further, the fixing member has a plurality of labels on the surface, so that the food storage date of the container can be labeled.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
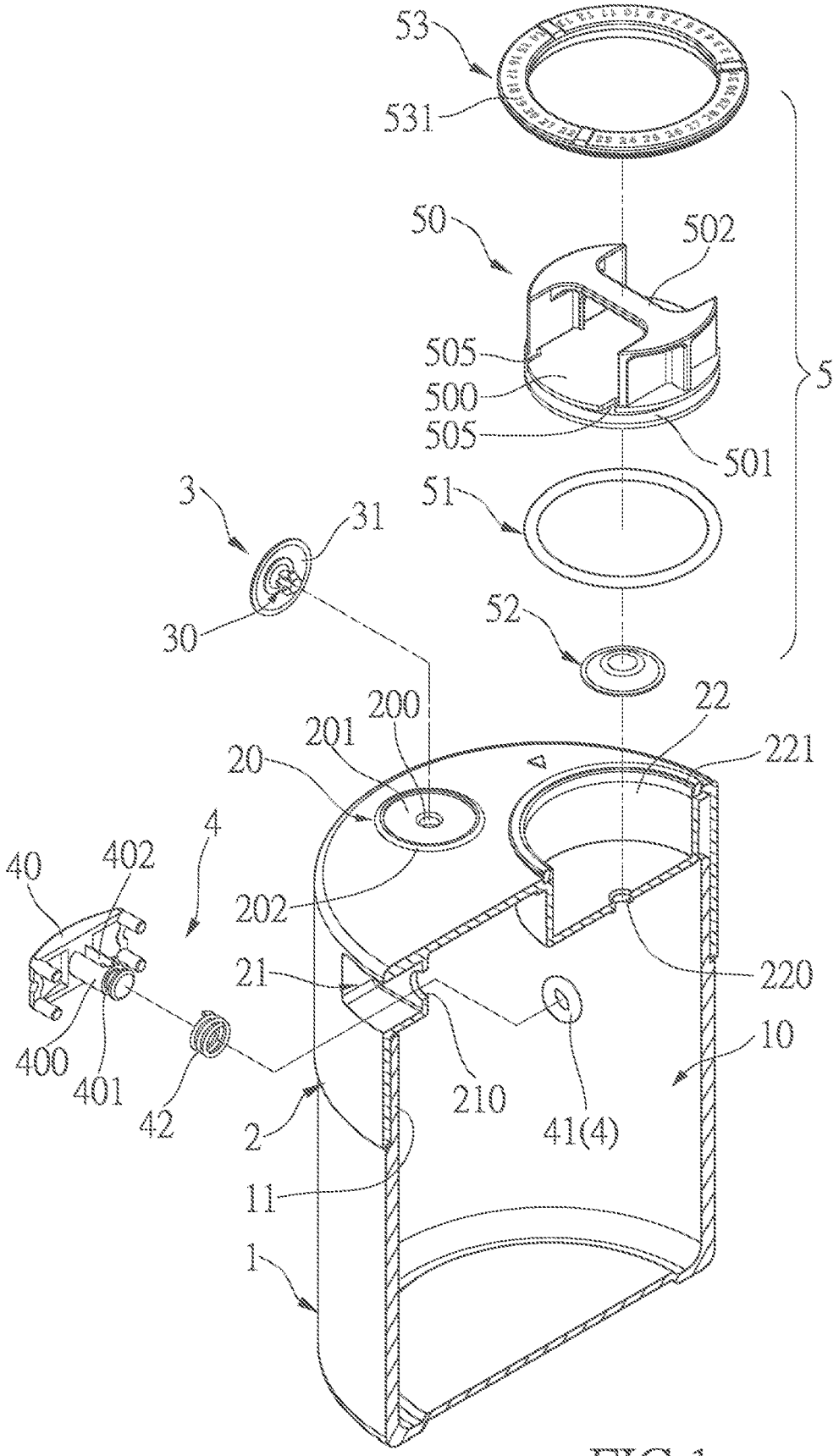
FIG. 1 is an exploded perspective schematic view of the present disclosure.
Figure 2:
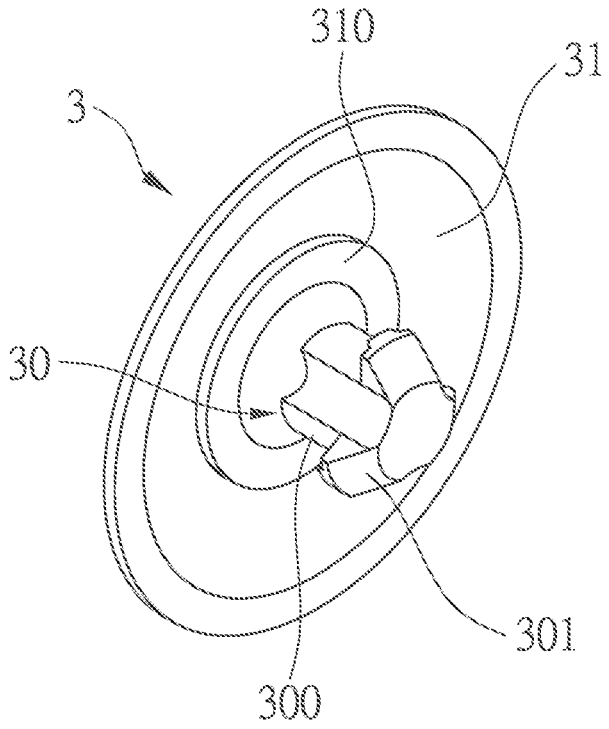
FIG. 2 is an enlarged schematic view of the elastic outlet unit of the present disclosure.
Figure 3:
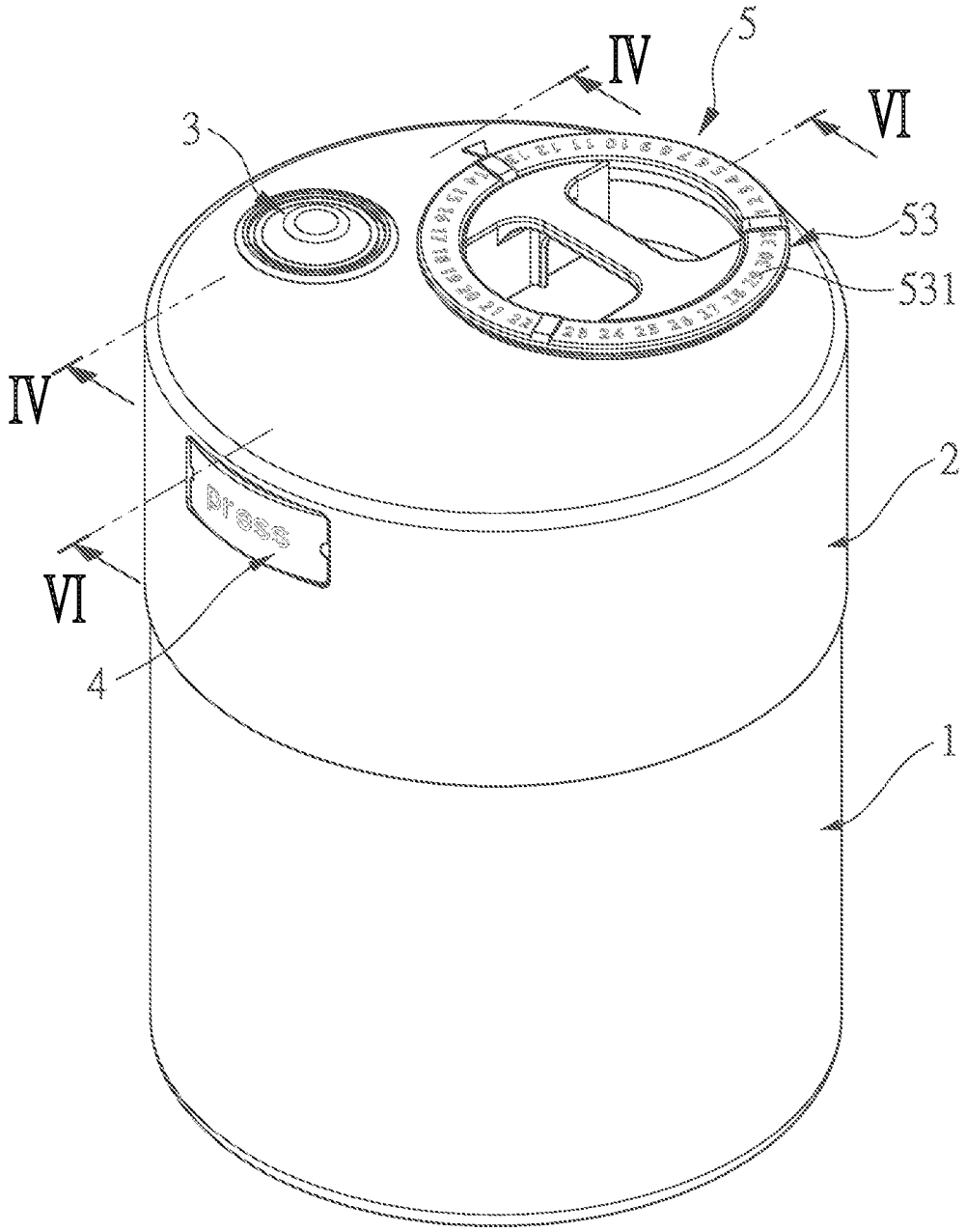
FIG. 3 is an assembled perspective schematic view of the present disclosure.
Figure 4:
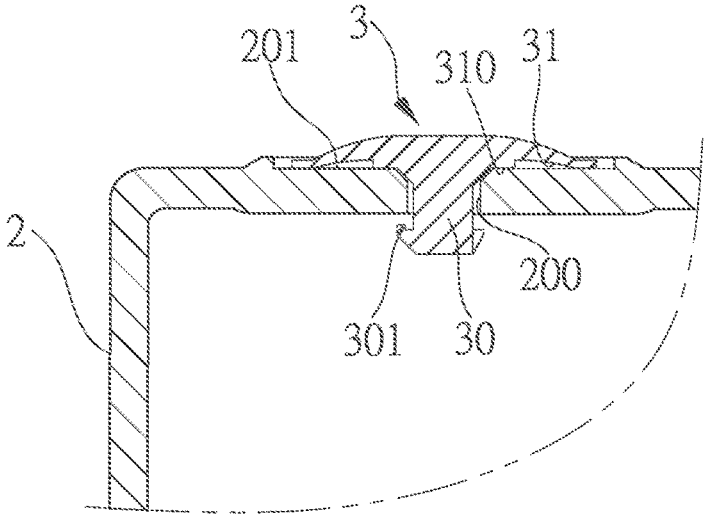
FIG. 4 is a sectional schematic view of line IV-IV of FIG. 3 of the present disclosure.

The construction and method of operation of the present disclosure, together with additional objects and advantages thereof, will be best understood from the following description of one or more embodiment(s) when read in connection with the accompanying drawings.

Firstly, referring to FIG. 1 to FIG. 12. The present disclosure provides a vacuum airtight container. The airtight container comprises a container 1, a cover 2, an elastic outlet unit 3, a control unit 4 and an exhaust unit 5.

The container 1 has a storage space 10 and a joint portion 11 at the top. The storage space 10 is used for accommodating food.

The cover 2 is covered and tight-sleeved on the joint portion 11 of the container 1. The cover 2 has an outlet groove 20, a control groove 21 and an exhaust groove 22. In detail, the outlet groove 20 is located at the top of the cover 2. The outlet groove 20 has an outlet hole 200, and a first joint surface 201 extending outward from the outlet hole 200. The outlet hole 200 passes through the cover 2 and communicates with the storage space 10 of the container 1. A stop ring 202 is convexly encircled the first joint surface 201. The control groove 21 is located at the side of the cover 2. The control groove 21 has a through hole 210, and the through hole 210 passes through the cover 2 and is communicated with the storage space 10 of the container 1. The exhaust groove 22 has an exhaust hole 220 at the top of the cover 2, and the exhaust hole 220 passes through the cover 2 and communicates with the storage space of the container 1. The exhaust groove 22 has a first retaining part 221 on the peripheral edge.

The elastic outlet unit 3 has a second joint surface extending outward from the first connecting portion, the first connecting portion 30 has a ring rib part 300 on the surface and a hook rib part 301 at the end. The second joint surface 31 of the first connecting portion 30 and the first joint surface 201 of the outlet groove 20 complement each other. The second joint surface 31 has a convex ring part 310 near the first connecting portion 30. When the elastic outlet unit 3 is fitted in the outlet groove 20, the stop ring 202 of the outlet groove 20 limits the elastic outlet unit 3 at the position. When the first connecting portion 30 of the elastic outlet unit 3 is connected with the outlet hole 200, the convex ring part 310 of the second joint surface 31 is pressed against the outlet hole 200, and the ring rib part 300 and the hook rib part 301 of the first connecting portion 30 allow the elastic outlet unit 3 more fittingly attached to the outlet groove 20.

The control unit 4 has a control member 40, a fastener member 41, and an elastic member 42.

The control member 40 is integral molding with an axis part 400, the axis part 400 has a fitting part 401 and a recess 402, and the fitting part 401 accommodates the fastener member.

The fastener member 41 stops the through hole 210 of the control groove 21 from the inner side of the cover 2. The elastic member 42 is assembled on the axis part 400, and the axis part 400 is inserted into the control groove 21 from the outer side of the cover 2. The fastener member 41 limits the through hole 210 of the control groove 21 and stop the through hole 210. In addition, the through hole 210 of the control groove 21 is not communicated with the storage space 10 of the container 1, so that the storage space 10 of the container 1 is sealed and moisture-proof. In one embodiment, the elastic member 42 is a telescopic spring.

The exhaust unit 5 includes an exhaust member 50, an elastic positioning ring 51, an elastic leakage stopper 52, and a fixing member 53.

The exhaust member 50 includes a pressing part 500. The pressing part 500 has an annular groove 501 recessed at the side wall, a pulling handle 502 on the top, and an airflow groove portion 503 recessed at the bottom. Moreover, the airflow groove portion 503 has a protrusion 504, the outer edge of the pressing part 500 has a plurality of slots 505, and the slots 505 are communicated with the annular groove 501.

The elastic positioning ring 51 slides in the annular groove 501 of the pressing part 500. When the exhaust member 50 is not pulled upward, the elastic positioning ring 51 is closely attached to the annular groove 505 of the pressing part 500.

Further, the elastic leakage stopper 52 has a second connecting portion 520 corresponding to the location of the exhaust hole 220 of the exhaust groove 22, and the elastic leakage stopper 52 connects to the exhaust hole 220 of the exhaust groove 22 through the second connecting portion 520.

The fixing member 53 is hollow and includes a first retaining part 530 fitted to the second retaining part 221 of the exhaust groove 22. The fixing member 53 has a plurality of labels 531 on the surface. In one embodiment, the plurality of labels 531 shows the date so that the user can note the food storage date of the container.

When the exhaust member 50 is disposed at the exhaust groove 22 of the cover 2, a protrusion 504 of the pressing part 500 of the exhaust member 50 is abutted against the top of the elastic leakage stopper 52. The second retaining part 530 of the fixing member 53 complements the first retaining part 221 of the exhaust groove 22, so that the exhaust member 50 can be retained at the exhaust groove 22 in moving up and down operation.

Moreover, the use of the vacuum airtight container of the present disclosure is further described.

Figure 7:
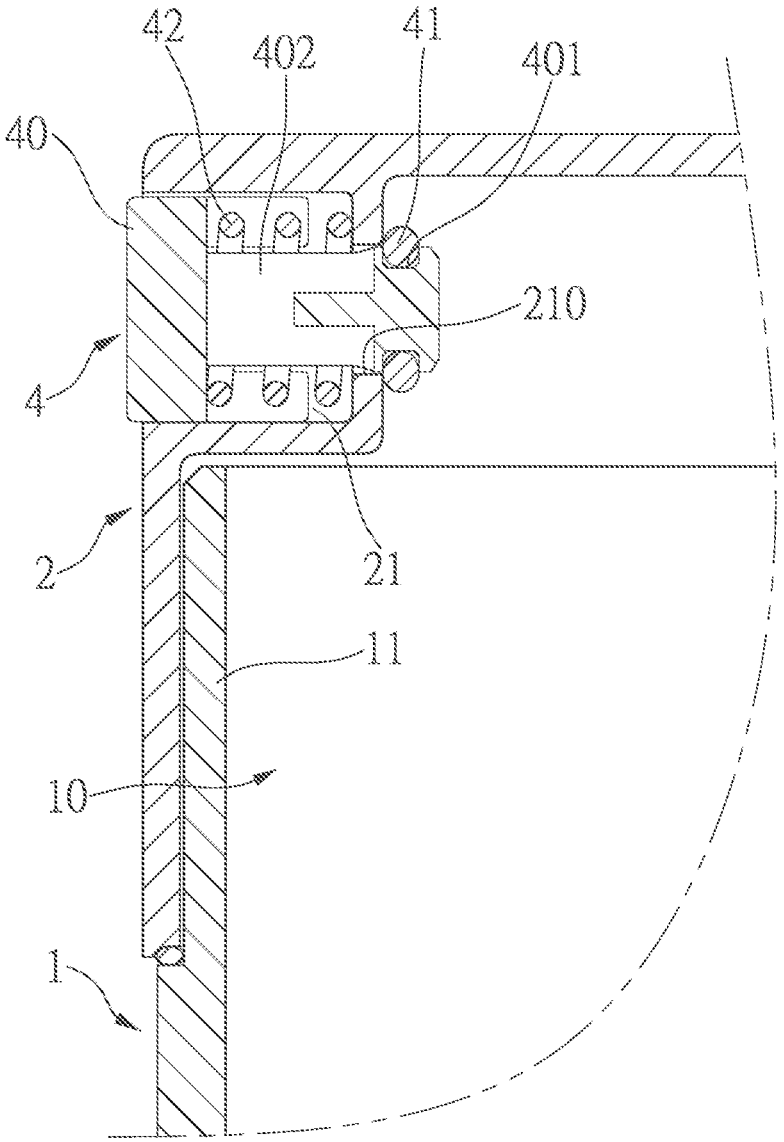
FIG. 7 is an enlarged schematic view of the control unit according to FIG. 6 of the present disclosure.
Figure 8:
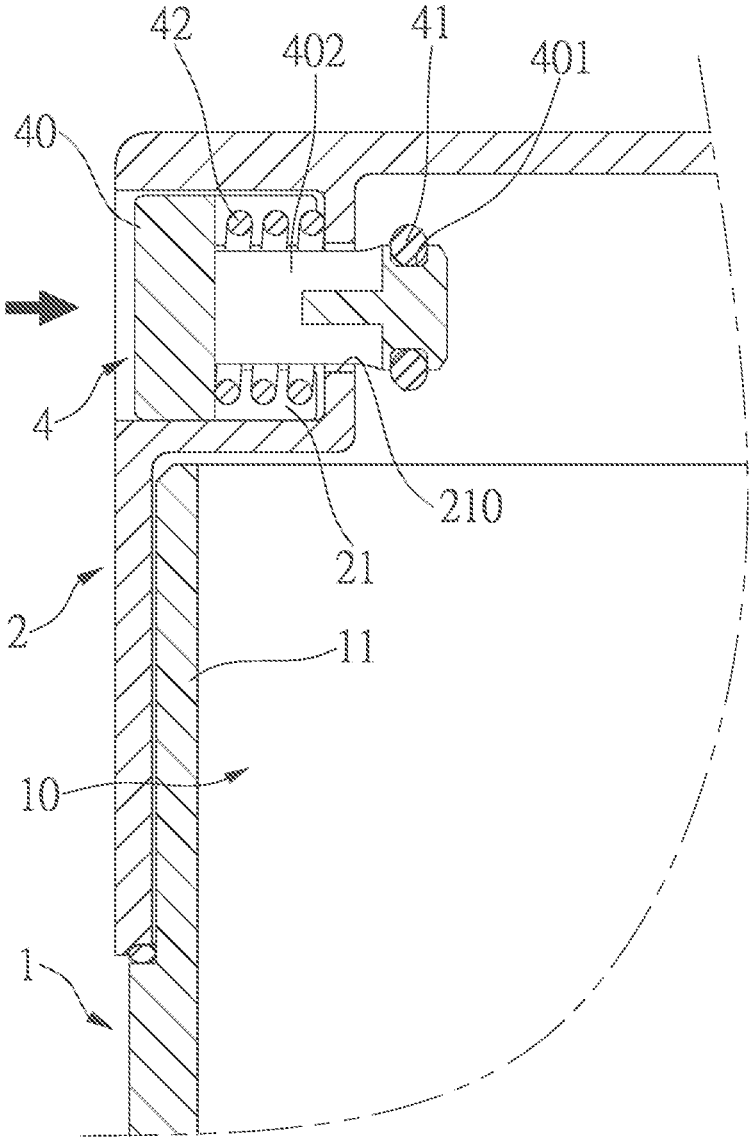
FIG. 8 is a schematic view of the movement of the control unit according to FIG. 7 of the present disclosure.
Figure 9:
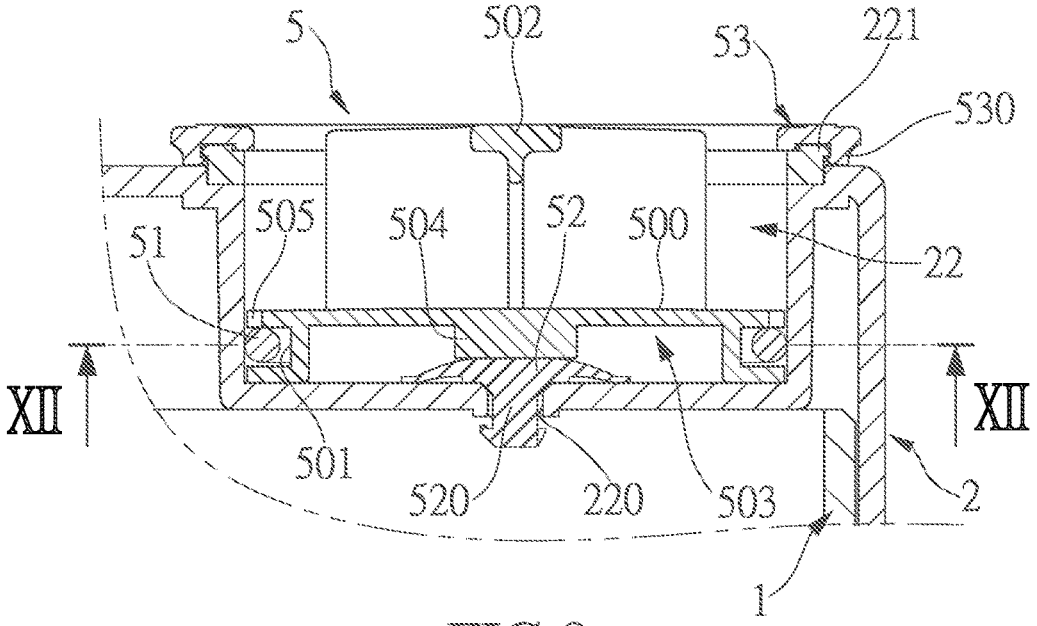
FIG. 9 is an enlarged schematic view of the exhaust groove and the exhaust unit of the present disclosure.

The description can be read in conjunction with FIG. 7 and FIG. 8. When the cover 2 is to be removed, press the control member 40 of the control unit 4, so that the control member 40 pushes the elastic member 42 and forms a compressed state of the elastic member 42. The axis part 400 of the control member 40 inserts the inner side of the cover 2 from the through hole 210 of the control groove 21, the fastener member 41 of the axis part 400 of the control member 40 away from the through hole 210 of the control groove 21, so that the through hole 210 forms an open state and communicates with the storage space of the container 1. Meanwhile, external air is allowed to enter the storage space 10 of the container 1 from the recess 402 of the axis part 400 of the control member 400, and through the through hole 210 of the control groove 21. Further, the cover 2 can be removed.

Conversely, when the cover 2 is covered on the container 1, press the control member 40 of the control unit 4. In the same way, the cover 2 can be easily sleeved and covered on the joint portion 11 of the container 1 due to the external air can pass the through hole 210 of the control groove 21 through the recess 402 of the axis part 400 of the control member 40, and communicates with the storage space 10 of the container 1.

When the control member 40 is released, the control member 40 forms a rebound action due to the elastic recovery of the elastic member 42, the fastener member 41 of the axis part 400 of the control member 40 stops the through hole 21 of the control groove 21, so that the external air cannot communicate with the storage space 10 of the container 1. Under the principle of atmospheric pressure, the cover 2 is tightly sleeved on the container 1 and cannot be removed, so that the storage space 10 of the container 1 achieves gas-tight and moisture-proof effects.

Figure 5:
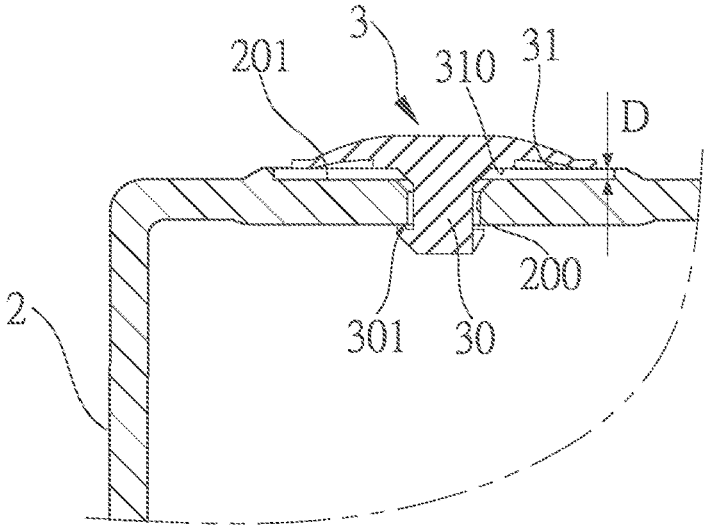
FIG. 5 is a sectional schematic view of the movement according to FIG. 4 of the present disclosure.
Figure 6:
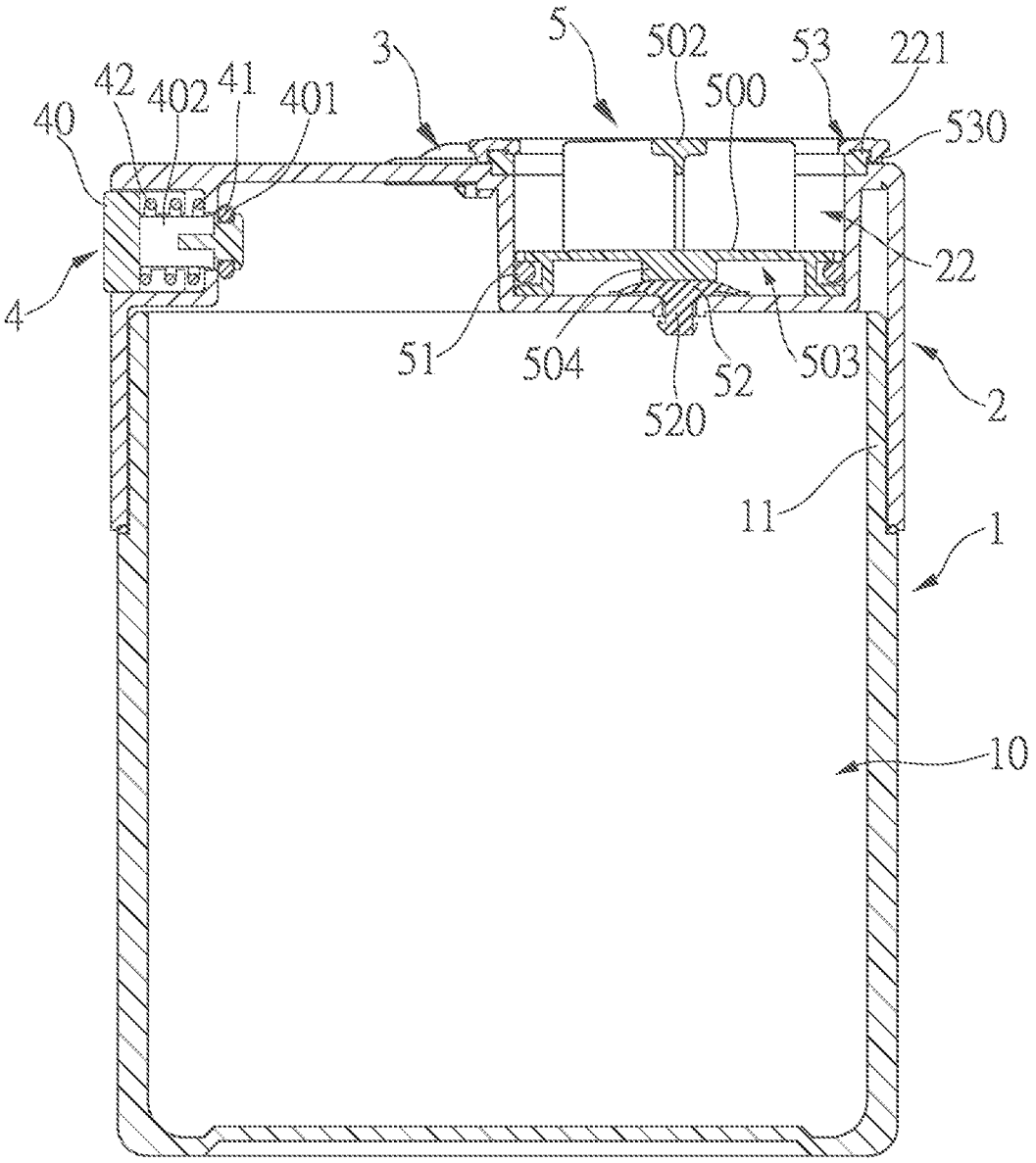
FIG. 6 is a sectional schematic view of line VII-VII of FIG. 3 of the present disclosure.

Further, when the pressure of the food fermentation gas in the storage space 10 of the container 1 increases, the gas in the storage space 10 of the container 1 will be discharged from an gas gap D between the elastic outlet unit 3 and the outlet groove 20 (as shown in FIG. 5), the food will not deteriorate due to the excessive air pressure in the storage space 10 of the container 1.

Figure 10:
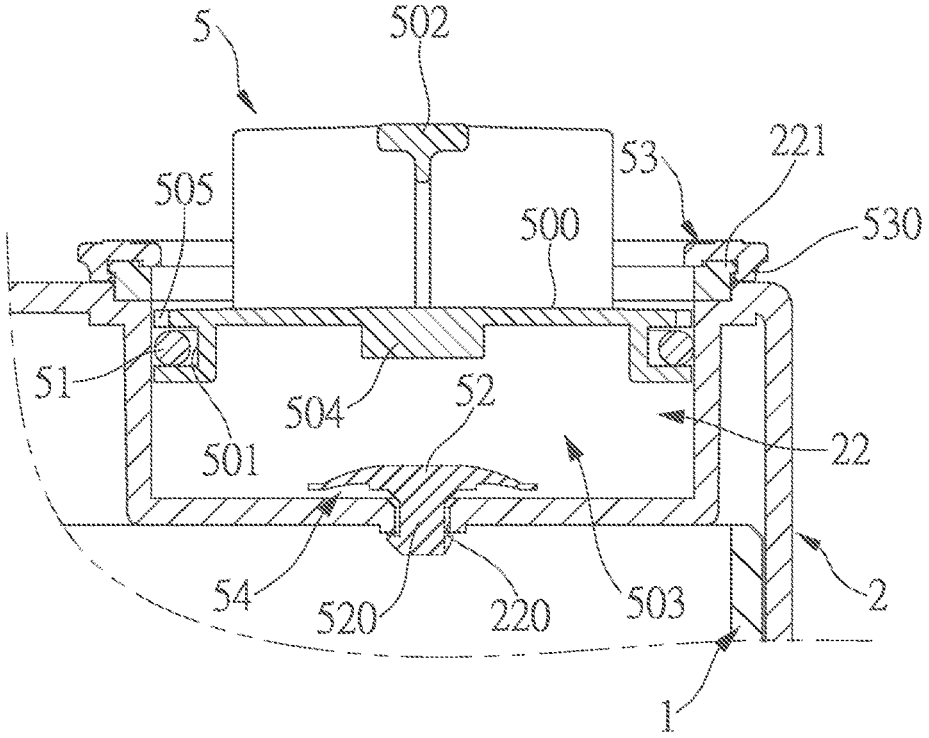
FIG. 10 is a sectional schematic view of the movement according to FIG. 9 of the present disclosure.
Figure 11:
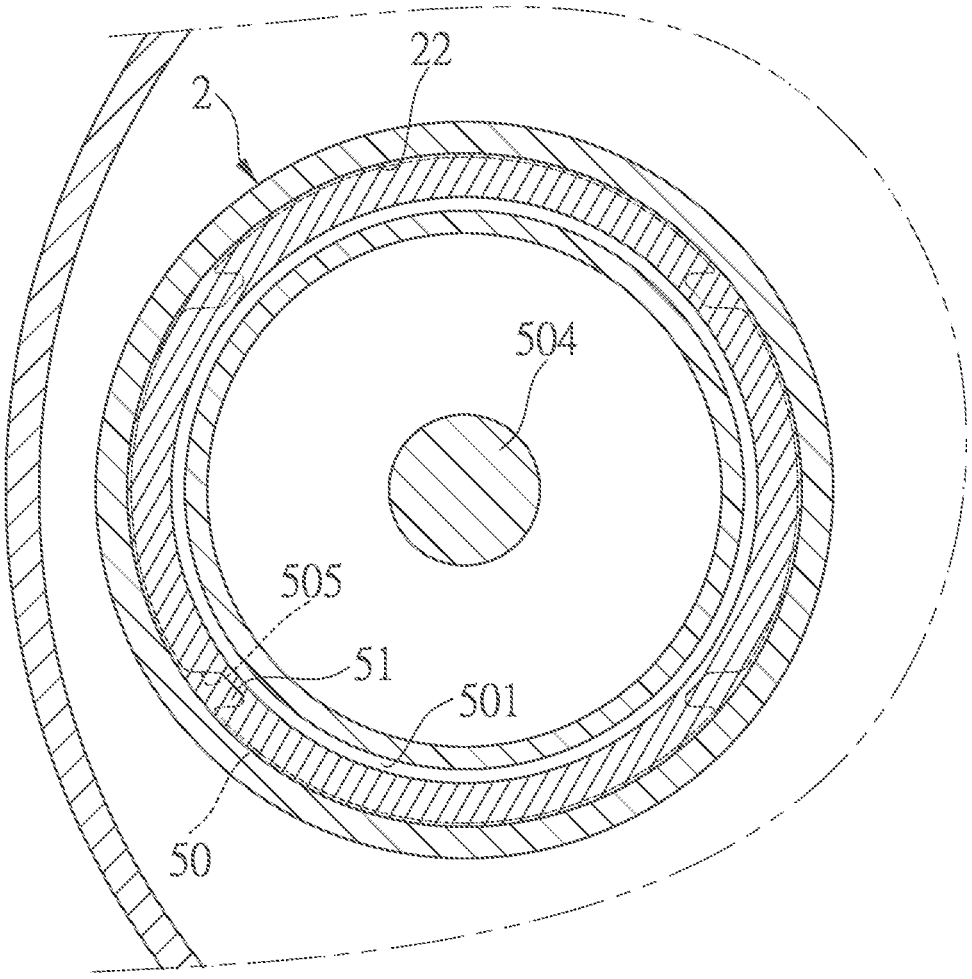
FIG. 11 is a sectional schematic view of line IX-IX of FIG. 9 of the present disclosure.

Moreover, when it is desired to form an approximate vacuum state of the storage space 10 of the container 1, pull the exhaust member 50 of the exhaust unit 5, so that the protrusion 504 of the pressing part 500 moves away from the abutting against the elastic leakage stopper 52 (as shown in FIG. 10).

Referring to FIG. 10, the air in the storage space 10 of the container 1 flows upward due to the upward pulling action of the exhaust member 50 and pushes the elastic leakage stopper 52, so that a first airflow channel 54 is formed between the elastic leakage stopper 52 and the bottom of the exhaust groove 22.

Figure 12:
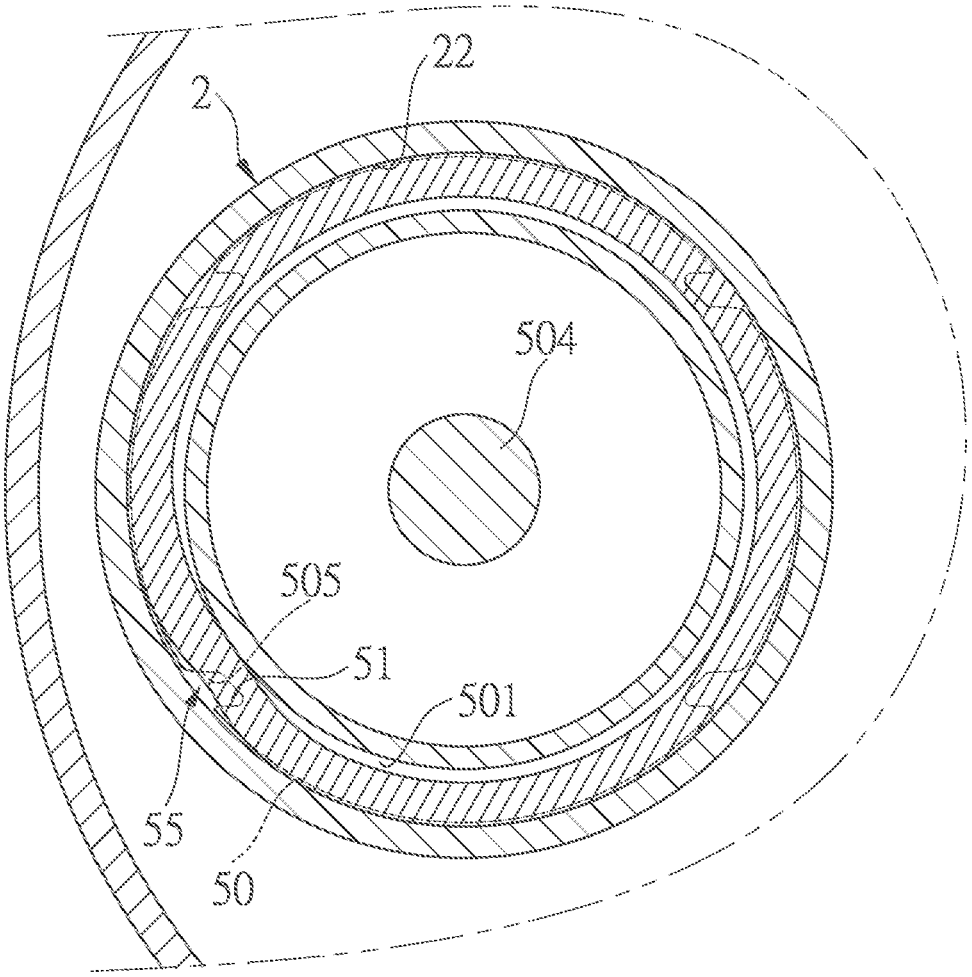
FIG. 12 is a sectional schematic view of the movement according to FIG. 10 of the present disclosure.

During the upward pulling action of the exhaust member 50, the elastic positioning ring 51 located in the annular groove 501 of the pressing part 500 moves downward under the influence of atmospheric pressure (as shown in FIG. 10). Meanwhile, the shape of elastic positioning ring 51 would be slight deformed, so that a plurality of second airflow channels 55 are formed between each slot 505 of the pressing part 500 and the elastic positioning ring 51 (as shown in FIG. 12).

Therefore, the air in the storage space 10 of the container 1 can flow to the airflow groove portion 503 through the first airflow channel 54, and then flow to each second airflow channel 55 through the airflow groove portion 503 to be discharged out of the container 1.

Conversely, during the exhaust member 50 of the exhaust unit 5 is pushed down, the elastic positioning ring 51 moves upwards under the influence of atmospheric pressure and is closely attached to each slot 505 of the pressing part 500, so as to prevent external air from entering the storage space 10 of the container 1 while pushing downward the exhaust member 50.

Accordingly, by repeating the pulling and pushing actions of the exhaust member 50 of the exhaust unit 5 at the exhaust groove 22 of the cover 2, the air in the storage space 10 of the container 1 can be drawn out of the container 1, and the storage space 10 of the container 1 can form an approximate vacuum state.

In summary, the vacuum airtight container of the present disclosure forms an approximate vacuum state of the storage space 10 of the container 1 by the exhaust member 50 of the exhaust unit 5. Further, the vacuum airtight container of the present disclosure can easily achieve the effect of assembling or disassembling the cover 2 and the container 1 by the actions of pressing or releasing the control member 40 of the control unit 4. Further, when the pressure of the food fermentation gas in the storage space 10 of the container 1 increases, the gas can be discharged from a gas gap D between the elastic outlet unit 3 and the outlet groove 20. Therefore, the purpose of preserving food can be achieved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching and will be suggested to persons skilled in the art and are to be included within the spirit and purview of the present disclosure and scope of the appended claims.

What is claimed is:

1. A vacuum airtight container, comprising:

a container, having a storage space;

a cover, covered and sleeved on the top of the container; wherein the cover has a control groove and an exhaust groove, the control groove has a through hole and the exhaust groove has an exhaust hole, the through hole and the exhaust hole are communicated with the storage space correspondingly;

a control unit, having a control member; wherein the control member is movably arranged at the control groove of the cover, the through hole of the control groove communicates with the storage space of the container by pressing the control member; and an exhaust unit, having an exhaust member disposed on the exhaust groove of the cover;

wherein when the exhaust member is pulled upwards, the air in the storage space of the container is discharged out of the container through the exhaust hole of the exhaust groove, so that the storage space of the container forms an approximate vacuum state.

2. The vacuum airtight container according to claim 1, wherein the cover includes an outlet groove having an outlet hole communicated with the storage space; wherein the outlet groove and the exhaust groove are disposed on the top of the cover and the control groove is disposed on the side of the cover; wherein the outlet groove has a first joint surface, and a stop ring convexly encircled the first joint surface.

3. The vacuum airtight container according to claim 2, further including an elastic outlet unit; wherein the elastic outlet unit has a first connecting portion, and the first connecting portion has a ring rib part and a hook rib part on the surface and the end, and the first connecting portion of the elastic outlet unit is connected to the outlet hole of the outlet groove and is limited by the stop ring.

4. The vacuum airtight container according to claim 3, wherein the elastic outlet unit has a second joint surface extending outward from the first connecting portion, and the second joint surface and the first joint surface of the outlet groove complement each other, the second joint surface has a convex ring part near the first connecting portion.

5. The vacuum airtight container according to claim 3, wherein the first connecting portion of the elastic outlet unit has a ring rib part and a hook rib part on the surface and the end.

6. The vacuum airtight container according to claim 1, wherein the control unit has a fastener member and an elastic member, and the control member has an axis part; wherein the fastener member and the elastic member are detachable and assembled on the axis part, and the fastener member close the through hole of the control groove when the axis part inserts the control groove from outside of the cover.

7. The vacuum airtight container according to claim 6, wherein the axis part of the control member has a fitting part on the surface for accommodating the fastener member.

8. The vacuum airtight container according to claim 6, wherein the axis part of the control member has a recess; wherein, by pressing the control member, the axis part inserts into the inner side of the cover from the through hole of the control groove, the fastener member moves away from the through hole of the control groove, so that the through hole communicates with the storage space, and allows external air entering the storage space of the container from the through hole of the control groove through the recess of the axis part of the control member.

9. The vacuum airtight container according to claim 1, wherein the exhaust unit further includes a pressing part, an elastic positioning ring and an elastic leakage stopper; wherein the pressing part has an annular groove recessed at the side wall, a pulling handle on the top and an airflow groove portion recessed at the bottom; wherein the airflow groove portion has a protrusion, the outer edge of the pressing part has a plurality of slots communicating with the annular groove, and the elastic positioning ring slides in the annular groove of the pressing part; wherein during process of pulling up or pushing down the exhaust member, the elastic positioning ring moves up and down in the annular groove of the pressing part; wherein the elastic leakage stopper has a second connecting portion corresponding to the location of the exhaust hole of the exhaust groove, and the elastic leakage stopper connects to the exhaust hole of the exhaust groove through the second connecting portion, and the protrusion of the airflow groove portion is abutted against on the elastic leakage stopper.

10. The vacuum airtight container according to claim 1, wherein the exhaust unit further includes a fixing member, and the fixing member is hollow and includes a first retaining part fitted to a second retaining part of the exhaust groove; wherein the second retaining part complement to the first retaining part, so that the exhaust member can be retained at the exhaust groove in operation; wherein the fixing member has a plurality of labels on the surface, so that the food storage date of the container can be labeled.

* * * * *